US007209692B2

(12) United States Patent
Hamada et al.

(10) Patent No.: US 7,209,692 B2
(45) Date of Patent: Apr. 24, 2007

(54) COLOR IMAGE FORMING APPARATUS AND DISCHARGING DEVICE BEFORE SECONDARY TRANSFER OF THE SAME

(75) Inventors: Shuta Hamada, deceased, late of Hachioji (JP); by Akira Hamada, legal representative, Hachioji (JP); by Yoshiko Hamada, legal representative, Hachioji (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/285,589

(22) Filed: Nov. 21, 2005

(65) Prior Publication Data

US 2006/0177245 A1 Aug. 10, 2006

(30) Foreign Application Priority Data

Feb. 4, 2005 (JP) ..... 2005-028644

(51) Int. Cl.
*G03G 15/16* (2006.01)

(52) U.S. Cl. ..... 399/296; 399/297; 399/310; 399/315

(58) Field of Classification Search ..... 399/296, 399/115, 121, 297, 310, 315, 318
See application file for complete search history.

(56) References Cited

U.S. PATENT DOCUMENTS 5,150,161 A * 9/1992 Bujese ..... 399/308
5,565,975 A * 10/1996 Kumon et al. ..... 399/302
5,905,931 A * 5/1999 Shigeta et al. ..... 399/309

FOREIGN PATENT DOCUMENTS

JP 10221964 A * 8/1998
JP 10-274892 10/1998
JP 10274892 A * 10/1998
JP 11-052763 2/1999
JP 11-143255 5/1999

* cited by examiner

*Primary Examiner*—David M. Gray
*Assistant Examiner*—Geoffrey T Evans
(74) *Attorney, Agent, or Firm*—Cantor Colburn LLP

(57) ABSTRACT

A color image forming apparatus is described, which makes highly durable image transferring possible. The color image forming apparatus includes: primary transferring devices to transfer unicolor toner images respectively formed on image bearing members onto an intermediate transfer member; a secondary transferring device to transfer the multi-color toner image onto a transfer material; a discharging device before secondary transfer, disposed at a position between a primary transferring device and the secondary transferring device; an electric discharge electrode disposed at a position opposing to the intermediate transfer member; an opposing electrode disposed at a position opposing to the electric discharge electrode while putting the intermediate transfer member between them; and a separating device to make the opposing electrode movable between an operating position at which the opposing electrode contacts the intermediate transfer member and a separating position being apart from the intermediate transfer member.

19 Claims, 6 Drawing Sheets

FIG. 3 ( a )
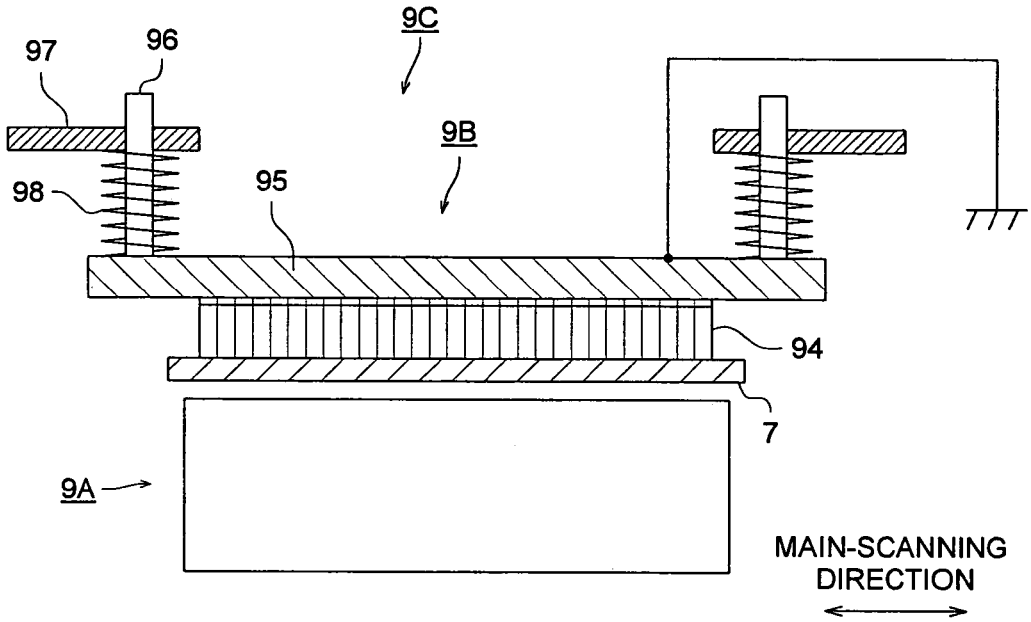
FIG. 3 ( b )
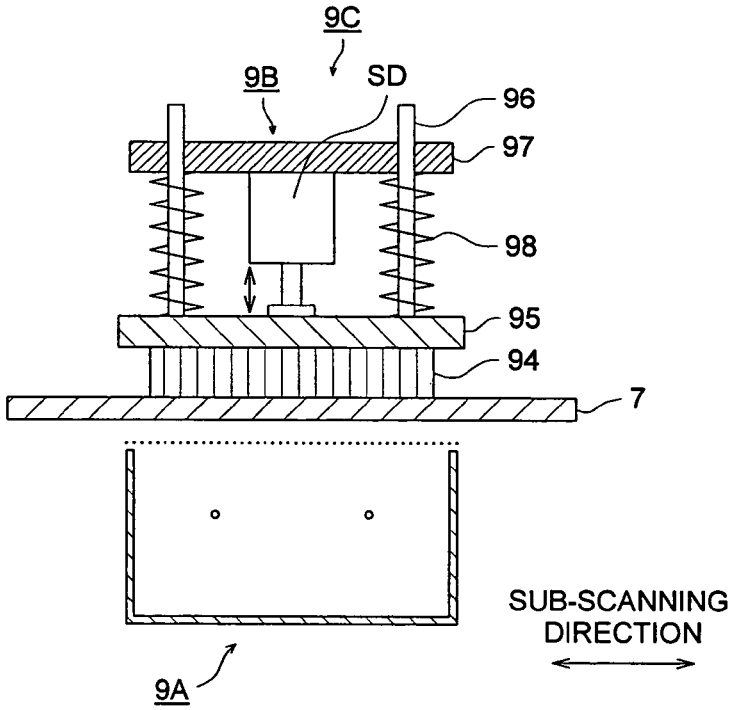

COLOR IMAGE FORMING APPARATUS AND DISCHARGING DEVICE BEFORE SECONDARY TRANSFER OF THE SAME

This application is based on Japanese Patent Application NO. 2005-028644 filed on Feb. 4, 2005 in Japanese Patent Office, the entire content of which is hereby incorporated by reference.

BACKGROUND OF THE INVENTION

The present invention relates to a color image forming apparatus employing an electro-photographic method, such as a copier, a printer, a facsimile and a complex image forming apparatus having the abovementioned functions, and specifically relates to a color image forming apparatus provided with an intermediate transfer member on which a plurality of unicolor toner images are overlapped with each other to form a full color image.

As the color image forming apparatus employing the intermediate transfer member, there has been well-known a color image forming apparatus in which toner images formed on image bearing members, each serving as a photosensitive material, are transferred onto the intermediate transfer member, and then, the toner image residing on the intermediate transfer member is further transferred onto a transfer material (hereinafter, also referred to as a paper, a sheet, or a sheet paper). In such the color image forming apparatus, the toner images, which are sequentially formed on the image bearing members and electronically charged in a predetermined polarity, are electro-statically transferred onto the intermediate transfer member by overlapping them with each other, and then, the full color toner image formed on the intermediate transfer member is further electro-statically transferred onto the transfer material at a time.

Since, in the image forming apparatus employing the intermediate transfer member, the toner images formed on the image bearing member can be overlapped onto the intermediate transfer member, such the image forming method is widely employed for the color image forming apparatus, which forms a color image on the transfer material. In the color image forming apparatus mentioned in the above, the different unicolor toner images respectively formed on the image bearing members are transferred onto the intermediate transfer member by overlapping them with each other, and then, the overlapped toner image is electro-statically transferred onto the transfer material at a time.

Since a charge amount per one particle of toner is substantially uniform, an electric potential of a toner layer on the intermediate transfer member is determined by an amount of toner attached. Accordingly, in the color image forming apparatus, the electric charge potential of an area where a plurality of unicolor toner images are overlapped with each other is higher than that of another area where a single unicolor toner image is attached, within the toner image formed on the intermediate transfer member. Further, for instance, when the toner image formed on the intermediate transfer member includes both a solid tone area and a halftone area, the electric charge potential of the solid tone area is greater than that of the halftone area.

Further, variations of the electric charge potential within the toner image, which has passed through a primary transferring section for transferring the toner image to the intermediate transfer member from the image bearing member are possibly generated depending on the environmental factor.

As mentioned in the above, a large variety of the electric charge potential within the toner image residing on the intermediate transfer member causes variations of transfer characteristics corresponding to various areas within the same toner image area. When partial toner images corresponding to such the various areas having transfer characteristics different from each other are tried to be transferred onto the transfer material under the same transferring condition, various kinds of image defects are liable to occur when performing the secondary transferring operation from the intermediate transfer member to the transfer material.

In recent years, the coloring trend has been progressed in the field of a copier, a printer, a facsimile, a complex image forming apparatus having such the functions, etc., and the demand for high image quality is getting large in the field of transferring process by employing polymerized toner or small-sized particle toner. Further, the speed-up trend of the image forming apparatus has been also progressed. Considering such the trends, to obtain a good image, it is necessary to compensate for the toner potential residing on the intermediate transfer member at a substantially uniform potential, which is liable to change depending on a number of primary transferring operations and the environmental factors, so as to improve an efficiency of the secondary transferring operation.

To overcome the abovementioned problems, Patent Document 1 sets forth a configuration in which a charging device before transfer for charging the toner image, which is primary-transferred onto the intermediate transfer member and to be transferred onto the transfer material, is provided, and a conductive roller member is disposed at rear side of the intermediate transfer member so that the electrode of the charging device before transfer is disposed opposite to the conductive roller member while putting the intermediate transfer member between them. According to the abovementioned method, the charging amount of the toner image transferred on the intermediate transfer member is made to be substantially uniform by applying AC and/or DC corona discharging operation to the toner image.

Patent Document 2 sets forth a method of equipping a controlling device for controlling the charging condition for the charging device before transfer, corresponding to the moving velocity of the intermediate transfer member, which passes through a charging point of the charging device before transfer.

Patent Document 3 sets forth a secondary transferring device, which includes a first member and a second member, both of which are made of conductive urethan rubber foam and volume resistivity of which are different from each other. At a time of room temperature, the first member press-contacts the intermediate transfer member, while, at a time of high temperature and high humidity, the second member press-contacts the intermediate transfer member.

[Patent Document 1]

Tokkaihei 10-274892 (Japanese Non-Examined Patent Publication)

[Patent Document 2]

Tokkaihei 11-143255 (Japanese Non-Examined Patent Publication)

[Patent Document 3]

Tokkaihei 11-52763 (Japanese Non-Examined Patent Publication)

To cope with the demand for the speed-up trend of the printing velocity, it is necessary to increase the contact area between the transferring roller and the intermediate transfer member, in order not to decrease the transferring efficiency. For this purpose, various countermeasures, such as an increase of the press-pressure of the transferring roller, a lowered elasticity of the sponge of the transferring roller, an increase of the diameter of the transferring roller, etc., have been conventionally employed.

However, when the countermeasure(s) of increasing the press-pressure of the transferring roller and/or lowering elasticity of the sponge of the transferring roller are/is employed, an increase of replacing frequency of the transferring roller due to the low durability of the transferring roller would arise as another problem. Further, when the countermeasure of increasing the diameter of the transferring roller is employed, an increase of apparatus size and an increase of manufacturing cost would arise as another problem.

In the method set forth in Patent Document 1 and Patent Document 2, since the charge amount of toner on the intermediate transfer member is uniformed at a relatively large value, image defects, caused by discharging action due to a potential elevation of the paper when the resistivity of the paper is high due to a low humidity environment or at the time of transferring the second surface of the paper in the duplex copy mode, are liable to occur. If the transferring voltage is kept at low value in order to prevent such the image defects, the transferring electric field would be short at a partial area where the total charge amount of the toner layer is large, resulting in a density unevenness in a reproduced image.

Further, in the configuration, set forth in Patent Document 1 and Patent Document 2, in which the conductive roller member is disposed at rear side of the intermediate transfer member so that the electrode of the charging device before transfer is disposed opposite to the conductive roller member while putting the intermediate transfer member between them, since the line velocity of the intermediate transfer member becomes high in the high-speed image forming apparatus, it becomes difficult to acquire a sufficient charging effect, and further, the configuration for controlling the charging condition, etc. corresponding to the line velocity of the intermediate transfer member would become complex.

In the method set forth in Patent Document 1, although the transferring operation is achieved by directly contacting the secondary transferring device, which includes the first member and the second member, both of which are made of the conductive urethan rubber foam, there has been a problem that it is difficult to maintain initial efficiencies of the image forming apparatus, since paper particles caused by contacting actions or abrasion moving actions between the secondary transferring device and the transfer material adhere to the surface of the secondary transferring device.

To overcome the abovementioned drawbacks in conventional image forming apparatus, it has been desired to provide an image forming apparatus, in which the transferring efficiency is improved in order to acquire a high quality image and the discharging function before the secondary transfer, which makes the high durable transferring operation possible, is equipped.

SUMMARY OF THE INVENTION

The cited shortcomings in conventional image forming apparatus can be overcome by the color image forming apparatus, embodied in the present invention, described as follow.

(1) A color image forming apparatus, having:

a plurality of primary transferring devices to transfer a plurality of color toner images respectively formed on a plurality of image bearing members onto an intermediate transfer member;

a secondary transferring device to transfer the color toner image formed on the intermediate transfer member, onto a transfer material;

a discharging device before secondary transfer, disposed at a position between a primary transferring device and the secondary transferring device, wherein the primary transferring device is one of the plurality of primary transferring devices located at a position nearest to the secondary transferring device, and wherein the discharging device before secondary transfer includes:

an electric discharge electrode disposed at a position opposing to a toner image bearing surface of the intermediate transfer member; and an opposing electrode made of a conductive material and disposed at a position opposing to the electric discharge electrode while putting the intermediate transfer member between them in such a manner that the opposing electrode face-contacts the intermediate transfer member; and a separating device to make the opposing electrode movable between an operating position at which the opposing electrode contacts the intermediate transfer member and a separating position being apart from the intermediate transfer member.

(2) A color image forming apparatus, having:

a plurality of primary transferring devices to transfer a plurality of unicolor toner images respectively formed on a plurality of image bearing members onto an intermediate transfer member in such a manner that the plurality of unicolor toner images overlap with each other to form a multi-color toner image;

a secondary transferring device to transfer the multi-color toner image, formed on the intermediate transfer member, onto a transfer material at a time;

a discharging device before secondary transfer, disposed at a position between a primary transferring device and the secondary transferring device, wherein the primary transferring device is one of the plurality of primary transferring devices located at a position nearest to the secondary transferring device, and wherein the discharging device before secondary transfer includes:

an electric discharge electrode disposed at a position opposing to a toner image bearing surface of the intermediate transfer member; and an opposing electrode made of a conductive material and disposed at a position opposing to the electric discharge electrode while putting the intermediate transfer member between them in such a manner that the opposing electrode face-contacts the intermediate transfer member;

a first separating device to make the plurality of image bearing members and the intermediate transfer member come apart from each other; and a second separating device to make the opposing electrode movable between an operating position at which the opposing electrode contacts the intermediate transfer member and a separating position being apart from the intermediate transfer member;

wherein a monochrome mode for forming a black toner image and a color mode for forming a color toner image by overlapping the plurality of unicolor toner images with each other are selectively provided in the image forming apparatus; and wherein, when forming the black toner image in the monochrome mode, the second separating device moves the opposing electrode to the separating position, in conjunction with an action of making the intermediate transfer member come apart from the plurality of image bearing members by the first separating device.

(3) A color image forming apparatus, having:

a plurality of primary transferring devices to transfer a plurality of color toner images respectively formed on a plurality of image bearing members onto an intermediate transfer member;

a secondary transferring device to transfer the color toner image formed on the intermediate transfer member, onto a transfer material at a time;

a discharging device before secondary transfer, disposed at a position between a primary transferring device and the secondary transferring device, wherein the primary transferring device is one of the plurality of primary transferring devices located at a position nearest to the secondary transferring device, and wherein the discharging device before secondary transfer includes:

an electric discharge electrode disposed at a position opposing to a toner image bearing surface of the intermediate transfer member; and an opposing electrode made of a conductive material and disposed at a position opposing to the electric discharge electrode while putting the intermediate transfer member between them in such a manner that the opposing electrode face-contacts the intermediate transfer member;

a separating device to make the opposing electrode movable between an operating position at which the opposing electrode contacts the intermediate transfer member and a separating position being apart from the intermediate transfer member; and a press-contact releasing device to release a press-contacting state of the secondary transferring device and the intermediate transfer member;

wherein, in an adjusting mode in which the secondary transferring device does not transfer the color toner image formed on the intermediate transfer member onto the transfer material, the separating device moves the opposing electrode to the separating position in conjunction with a press-contact releasing operation conducted by the press-contact releasing device.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 3(*a*) and FIG. 3(*b*) show cross sectional views of a press-contacting release mechanism of an opposing electrode in a discharging device before secondary transfer;

DETAILED DESCRIPTION OF THE PREFERRED EMBODIMENT

Figure 1:
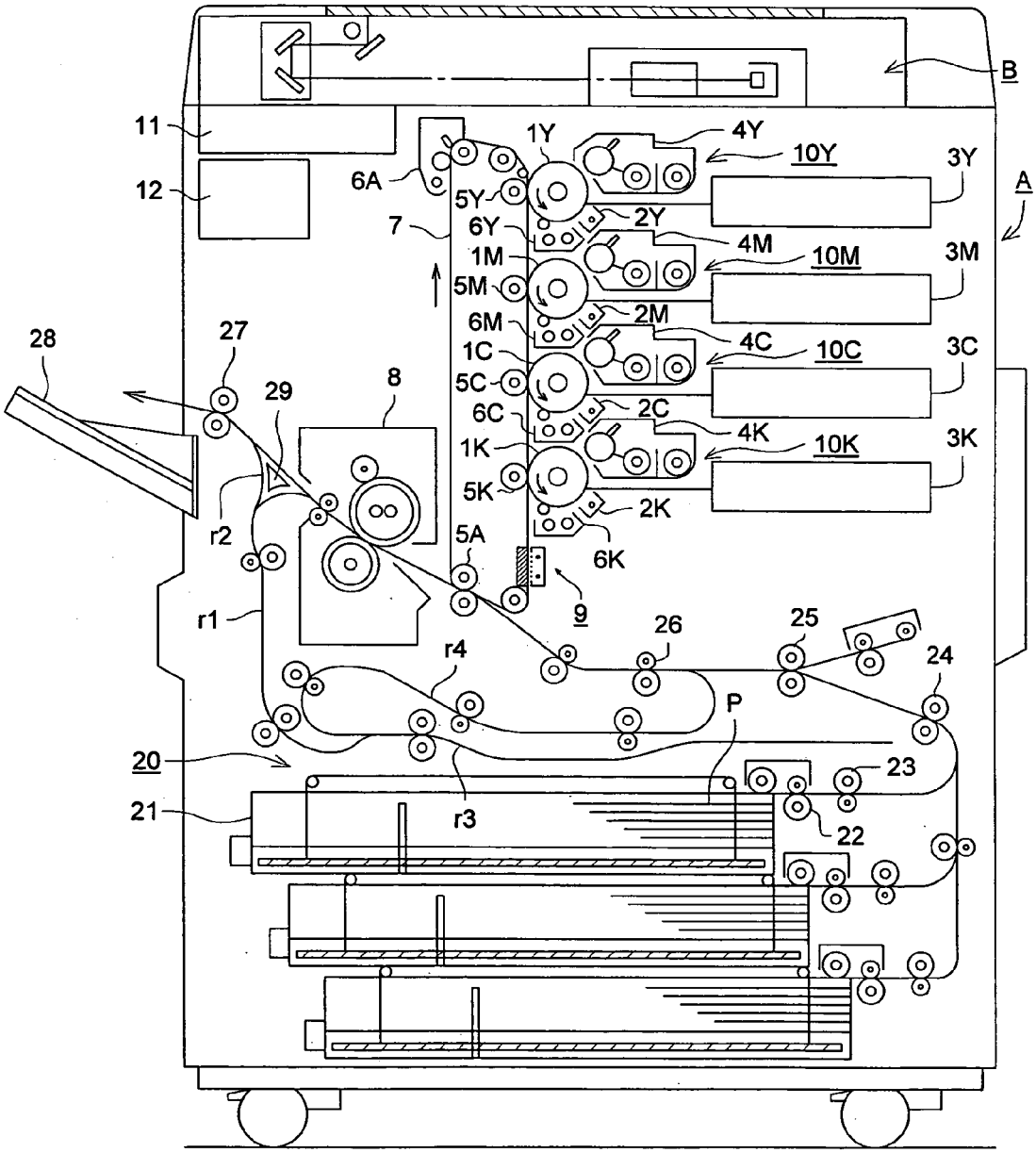
FIG. 1 is a cross sectional view of a color image forming apparatus embodied in the present invention, showing a whole configuration of the color image forming apparatus.

Referring to the drawings, the embodiment of the present invention will be detailed in the following. The scope of the present invention, however, is not limited to the embodiment indicated in the following.

<Color Image Forming Apparatus>

Figure 2:
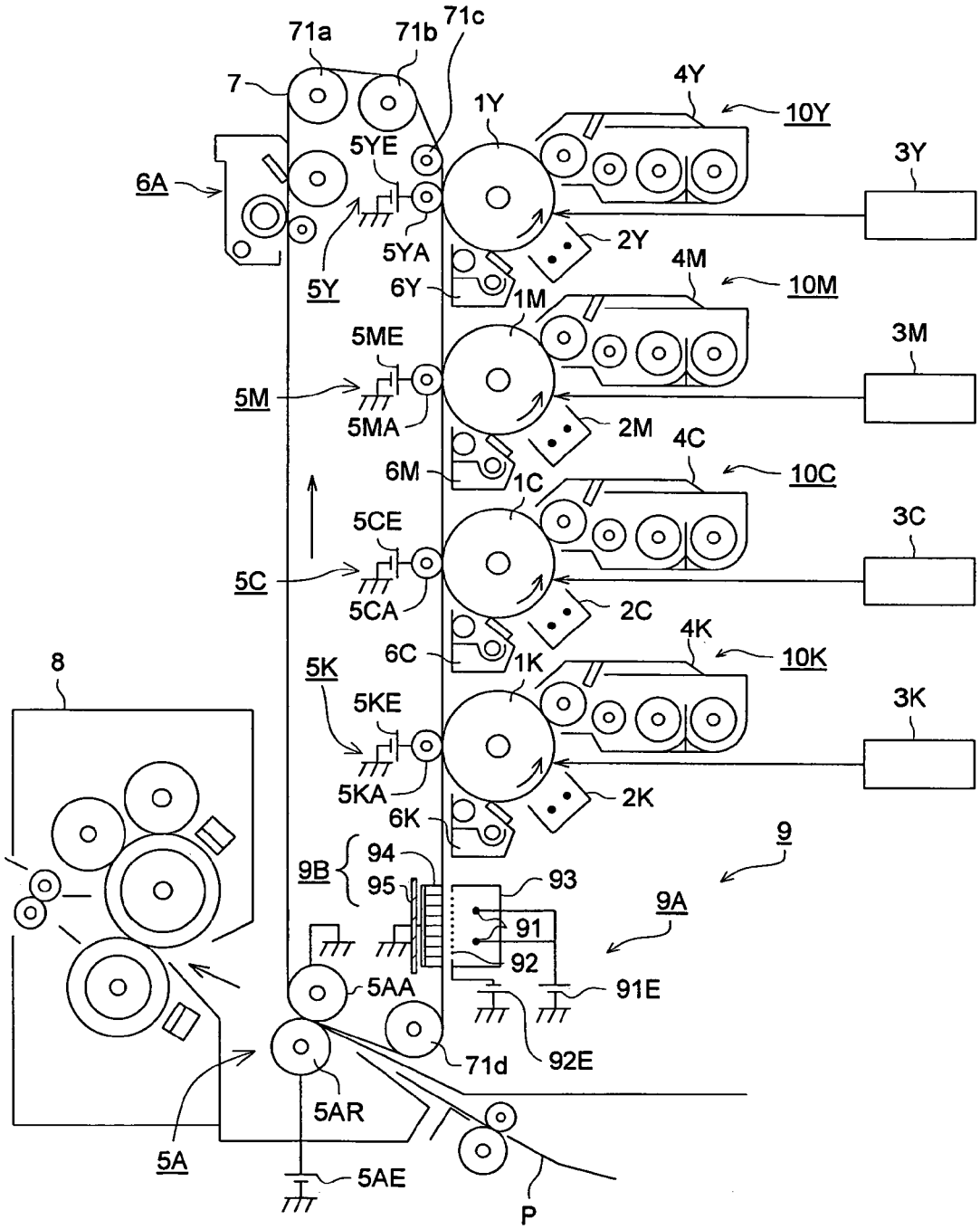
FIG. 2 is a cross sectional view of a main section of a color image forming apparatus embodied in the present invention.

FIG. 1 is a cross sectional view of a color image forming apparatus embodied in the present invention, showing a whole configuration of a color image forming apparatus A. FIG. 2 is a cross sectional view of a main section of the color image forming apparatus A.

The color image forming apparatus A is called a tandem-type color image forming apparatus, which includes plural sets of image forming sections 10Y, 10M, 10C, 10K, an intermediate transfer member 7 shaped in a belt, primary transferring devices 5Y, 5M, 5C, 5K, an intermediate transfer unit including a secondary transferring device 5A, a paper feeding device 20, a fixing device 8, an operating section 11 and an image creation controlling device 12.

An image reading apparatus B is mounted on the upper side of the color image forming apparatus A. A document put on the document plate is read by scanning a light, emitted from the optical system of the document image scanning-light exposure device in the image reading apparatus B, onto an image on the document, so that the line image sensor read the image. In the image processing section, various kinds of processing, including an analogue processing, an analogue to digital converting processing, a shading processing, an image compression processing, etc., are applied to analogue signals photo-electronically converted by the line image sensor to generate processed image data, and then, the processed image data are inputted into exposing devices 3Y, 3M, 3C, 3K.

The image forming section 10Y for forming a unicolor image of color Y (Yellow) includes a charging device 2Y, an exposing device 3Y, a developing device 4Y and a cleaning device 6Y, which are arranged along the circumferential surface of a photoreceptor drum 1Y, serving as an image bearing member.

The image forming section 10M for forming a unicolor image of color M (Magenta) includes a charging device 2M, an exposing device 3M, a developing device 4M and a cleaning device 6M, which are arranged along the circumferential surface of a photoreceptor drum 1M, serving as an image bearing member.

The image forming section 10C for forming a unicolor image of color C (Cyan) includes a charging device 2C, an exposing device 3C, a developing device 4C and a cleaning device 6C, which are arranged along the circumferential surface of a photoreceptor drum 1C, serving as an image bearing member.

The image forming section 10K for forming a unicolor image of color K (Black) includes a charging device 2K, an exposing device 3K, a developing device 4K and a cleaning device 6K, which are arranged along the circumferential surface of a photoreceptor drum 1K, serving as an image bearing member.

Each combination of the charging device 2Y and the exposing devices 3Y, the charging device 2M and the exposing devices 3M, the Charging device 2C and the exposing devices 3C and the charging device 2K and the exposing devices 3K constitutes a latent image forming section.

Although a well-known photosensitive material, such as an OPC photosensitive material, an aSi photosensitive material, etc., can be employed for the photoreceptor drums 1Y, 1M, 1C, 1K, specifically, an OPC photosensitive material having a negative electrostatic charging property is preferably employed. In the present embodiment, an OPC photosensitive material having a negative electrostatic charging property is employed.

Although a corona discharging device, such as a scorotron discharger, a corotron discharger, etc., can be employed as each of the charging devices 2Y, 2M, 2C, 2K, the scorotron discharger is preferably employed for this purpose.

A light emitting element, such as a laser, a LED array, etc., which emits light according to the image data, can be employed as each of the exposing devices 3Y, 3M, 3C, 3K.

The intermediate transfer member 7, shaped in a belt and having a semi-conductive property, is threaded on a plurality of rollers 71*a*, 71*b*, 71*c*, 71*d*, etc., so as to support it in a circularly movable state. In the present embodiment, the intermediate transfer member 7 is supported in such a manner that a partial surface of the intermediate transfer member 7 between the roller 71*c* and the roller 71*d* is kept as a flat plane. In other words, the roller 71*c* and the roller 71*d* serve as supporting members.

The unicolor images formed by the image forming sections 10Y, 10M, 10C, 10K are sequentially and respectively transferred onto the intermediate transfer member 7, being circularly moving, by the primary transferring devices 5Y, 5M, 5C, 5K (the primary transferring operation), so as to form a synthesized full color image.

A transfer material P accommodated in a paper feeding cassette 21 of the paper feeding device 20, serving as a paper accommodating section, is fed by a paper feeding roller 22 (the first paper feeding section) and conveyed to the secondary transferring device 5A through paper feeding rollers 23, 24, 25 and a registration roller 26 (the second paper feeding section), and then, the color toner image is transferred onto the transfer material P (the secondary transferring operation).

The fixing device 8 applies heat and pressure onto the transfer material P, on which the color toner image is already transferred, so as to fix the color toner image (or a toner image) onto the transfer material P. Then, the transfer material P, having the fixed color toner image on it, is ejected by an ejecting roller 27 and stacked on an ejecting tray 28 disposed outside the apparatus.

On the other hand, after transferring the color toner image onto the transfer material P by means of the secondary transferring device 5A, the transfer material P is separated from the intermediate transfer member 7 by the curvature separating action, and then, residual toner remaining on the surface of the intermediate transfer member 7 are removed by the intermediate transfer member cleaning device 6A.

When the transfer material P, on which the color toner image is already fixed, is ejected in a reverse ejecting mode, the transfer material P passes through a conveying path located at a right side of a branch plate 29 disposed at a branch point located at a middle point between the fixing device 8 and the ejecting roller 27 as shown in FIG. 1, and is conveyed into a conveying path r1. Then, the transfer material P is further conveyed in a reverse direction, so as to pass through a conveying path r2 located at a left side of a branch plate 29, and finally, ejected outside the apparatus by means of the ejecting roller 27.

When the duplex copy operation is applied to the transfer material P, the transfer material P is branched from the eject conveying path by means of the ejecting roller 27 after the fixing processing for the toner image formed on an obverse side of the transfer material P is completed. After introducing the transfer material P into the conveying path r1 and further into the conveying path r3, the transfer material P is further conveyed in a reverse direction, so as to introduce the transfer material P into the conveying path r4. Then, the transfer material P detours upward and is further conveyed by the registration roller 26. The toner image is formed on the reverse side of the transfer material P by means of the image forming sections 10Y, 10M, 10C, 10K, and fixed with heat and pressure onto the reverse side of the transfer material P by means of the fixing device 8. Finally, the transfer material P, having the toner images on its both sides, is ejected outside the apparatus by the ejecting roller 27.

<Primary Transferring Device>

The primary transferring device 5Y for transferring a unicolor toner image of color Y (Yellow) is constituted by a primary transferring roller 5YA and a primary transferring power source 5YE for applying a voltage to the primary transferring roller 5YA. The primary transferring roller 5YA is opposed to the photoreceptor drum 1Y while putting the intermediate transfer member 7 between them, and press-contacts the inner surface of the intermediate transfer member 7. Further, the primary transferring power source 5YE is coupled to the ground.

The primary transferring device 5M for transferring a unicolor toner image of color M (Magenta) is constituted by a primary transferring roller 5MA and a primary transferring power source 5ME for applying a voltage to the primary transferring roller 5MA. The primary transferring roller 5MA is opposed to the photoreceptor drum 1M while putting the intermediate transfer member 7 between them, and press-contacts the inner surface of the intermediate transfer member 7. Further, the primary transferring power source 5ME is coupled to the ground.

The primary transferring device 5C for transferring a unicolor toner image of color C (Cyan) is constituted by a primary transferring roller 5CA and a primary transferring power source 5CE for applying a voltage to the primary transferring roller 5CA. The primary transferring roller 5CA is opposed to the photoreceptor drum 1C while putting the intermediate transfer member 7 between them, and press-contacts the inner surface of the intermediate transfer member 7. Further, the primary transferring power source 5CE is coupled to the ground.

The primary transferring device 5K for transferring a unicolor toner image of color K (Black) is constituted by a primary transferring roller 5KA and a primary transferring power source 5KE for applying a voltage to the primary transferring roller 5KA. The primary transferring roller 5KA is opposed to the photoreceptor drum 1K while putting the intermediate transfer member 7 between them, and press-contacts the inner surface of the intermediate transfer member 7. Further, the primary transferring power source 5KE is coupled to the ground.

Each of the primary transferring power sources 5YE, 5ME, 5CE, 5KE, applies an electronic power having a current value of 40 μA and a voltage value of +1.5 kV to each of the primary transferring rollers 5YA, 5MA, 5CA, 5KA.

Further, when the primary transferring operation is not performed, each of the primary transferring devices 5Y, 5M, 5C, 5K comes apart from the inner surface of the intermediate transfer member 7 and is placed at a standby position, by means of a separating mechanism (not shown in the drawings).

<Secondary Transferring Device>

As shown in FIG. 2, the secondary transferring device 5A is constituted by a secondary transferring backup roller 5AA, a secondary transferring roller 5AR and a secondary transferring power source 5AE.

The secondary transferring backup roller 5AA is opposed to the secondary transferring roller 5AR while putting the intermediate transfer member 7 between them, and press-contacts the inner surface of the intermediate transfer member 7. Further, the secondary transferring backup roller 5AA is coupled to the ground. Still further, the secondary transferring power source 5AE for applying a voltage to the secondary transferring roller 5AR is coupled to the ground.

Numeral 6A indicates a intermediate transfer member cleaning device for cleaning the intermediate transfer member 7, while numeral 8 indicates a fixing device for fixing a toner image onto the transfer material P.

The intermediate transfer member 7 is a single layer or a multi layer belt made of a polyamide material, polyimide material, etc., and having a volume resistivity of $10^7$–$10^{12}$ Ωcm.

After the secondary transferring operation for the transfer material P performed by the secondary transferring device 5A is completed, the intermediate transfer member 7 passes through the intermediate transfer member cleaning device 6A, which clean the intermediate transfer member 7.

The secondary transferring power source 5AE of the secondary transferring device 5A applies an electronic power having a current value of 50 μA and a voltage value of +3 kV to the secondary transferring roller 5AR. The structure of the secondary transferring backup roller 5AA of the secondary transferring device 5A is substantially the same as that of the primary transferring roller 5YA, 5MA, 5CA, 5KA. The secondary transferring backup roller 5AA press-contacts the inner surface of the intermediate transfer member 7.

Further, when the secondary transferring operation is not performed, the secondary transferring roller 5AR comes apart from the surface of the intermediate transfer member 7 and is placed at a standby position, by means of a separating mechanism (not shown in the drawings).

<Discharging Device Before Secondary Transfer>

As shown in FIG. 2, the discharging device before secondary transfer 9 is disposed at a position along a flat plate portion of the intermediate transfer member 7 located between the primary transferring device 5K and the secondary transferring device 5A. The discharging device before secondary transfer 9 is constituted by a discharging electrode 9A disposed at an image bearing side of the intermediate transfer member 7 and an opposing electrode 9B disposed at inner side of the intermediate transfer member 7.

In the color image forming apparatus employing the intermediate transfer method, there has been a problem that, although the primary transferring efficiency is good for the primary color, the high-quality image can not be obtained due to the defect of the secondary transferring operation for the secondary color. This is because, since the distribution of toner, attached on the toner image formed on the intermediate transfer member 7, widely varies in a range from a single layer to four layers maximum, the secondary transferring condition cannot appropriately comply with each of various amounts of toner attached.

To cope with the abovementioned problem, the discharging device before secondary transfer 9 is equipped for discharging the toner image formed on the intermediate transfer member 7, so that the secondary transferring condition can comply with wide variety of amounts of toner attached. Incidentally, the discharging polarity can be suitable selected corresponding to the polarity of toner charged, in order to uniform the charge amount of toner.

However, to secure the discharging efficiency, according as the process speed of the image forming apparatus is improved, the length of a discharging electrode 9A of the discharging device before secondary transfer 9 should be extended longer than ever in the sub-scanning direction (the progressing direction of the intermediate transfer member 7). Inevitably, an opposing electrode 9B should be also extended longer than ever.

So far, a roller has been employed as the opposing electrode 9B. To cope with the trend for improving the process speed of the image forming apparatus, it is necessary not only to extend the contact length with the intermediate transfer member 7, but also to set the distance between the intermediate transfer member 7 and the discharging device before secondary transfer 9 at an appropriate distance.

To solve the abovementioned two problems, it is necessary to increase the outer diameter of the roller 71*d* so as to increase the winding angle of the intermediate transfer member 7. However, there has been a problem that such the countermeasure makes the apparatus large sized and/or an increase of the manufacturing cost of the apparatus.

To solve the abovementioned problems, by making a conductive brush and the opposing electrode 9B, made of conductive foam material, face-contact the intermediate transfer member 7 and coupled to the ground, it is achieved to improve the discharging efficiency higher than ever.

The conductive brush and the conductive foam material are preferable as an opposing electrode, which can secure a contacting area as wider as possible.

On the other hand, when the conductive brush and the opposing electrode 9B, made of conductive foam material, continuously keep face-contacting the intermediate transfer member 7, a deformation, an abrasion by friction, etc. of the opposing electrode 9B are liable to occur. In the present embodiment, since a press-contacting release mechanism (separating section) of the discharging device before secondary transfer 9 is provided so as to allow the opposing electrode 9B separating from the surface of the intermediate transfer member 7, it becomes possible to extend the lifetime of the opposing electrode. Further, the opposing electrode 9B press-contacts the surface of the intermediate transfer member 7, only when the discharging device before secondary transfer is activated. Still further, the opposing electrode 9B comes apart from the intermediate transfer member 7 except while the image forming operations are progressed in the image forming apparatus A. Accordingly, the lifetime of the opposing electrode 9B can be extended longer than ever.

<Discharging Electrode 9A>

The discharging electrode 9A is a scorotron discharging electrode constituted by an electric discharge electrode 91, a grid 92 and a casing 93.

The electric discharge electrode 91 is coupled to a power source 91E. The grid 92 is disposed at a position opposing to the belt surface of the intermediate transfer member 7 with a space between them and coupled to a power source 92E. The casing 93 is coupled at an electric potential same as that of the grid 92 by a circuit (not shown in the drawings).

Although a wire material, such as a tungsten wire, a stainless steel wire, a gold wire, etc., having a diameter of 20–150 μm, can be employed for the electric discharge electrode 91, specifically, it is preferable that the surface of the wire is formed by a gold material. It is applicable that the wire itself is made of gold, or the base material, such as the tungsten wire, a stainless steel wire, etc., is coated with gold. The thickness of the gold layer is preferably set at a value in a range of 1–5 μm, in view of the efficiency of removing the discharge products, such as ozone, etc., a manufacturing cost, a discharging efficiency, etc.

A wire grid, a plate-shaped grid formed by etching a metal plate into a grid pattern or a plate-shaped grid coated with gold can be employed as the grid 92.

The DC bias voltage in a range of 0–+5 kV is applied to the electric discharge electrode 91 so as to perform a discharging action in a polarity opposite to that of the toner, while the DC voltage in a range of 0–−300 V is applied to the grid 92. As an example, the DC bias voltage of +5 kV is applied to the electric discharge electrode 91, while the DC voltage of −100 V is applied to the grid 92.

In the present embodiment, the image forming apparatus is so constituted that the DC bias voltage in a range of 0–+5 kV can be applied to the electric discharge electrode 91 so as to perform the discharging action in the polarity opposite to that of the toner, while the DC voltage in a range of 0–−300 V can be applied to the grid 92.

In the present embodiment, the voltage of +4 kV is applied to the electric discharge electrode 91 of the discharging device before secondary transfer 9, while the voltage of −50 V is applied to the grid 92.

<Opposing Electrode 9B>

The opposing electrode 9B, which includes a conductive brush 94 and the press-contacting release mechanism for press-contacting/releasing the conductive brush 94 to/from the intermediate transfer member 7, is disposed at an inner surface side of the intermediate transfer member 7 opposing to the discharging device before secondary transfer 9. The conductive brush 94 press-contacts the inner surface side of the intermediate transfer member 7 and is coupled to the ground.

The conductive brush 94 is made of a conductive resin material, such as an acrylic, nylon, a polyester, etc., and is preferably constituted by the fibers having the specifications as follow: a diameter of each fiber is in a range of 0.111–0.778 tex in a measuring unit of yarn count proposed by ISO; a blush density is in a range of 12000–77000 fibers/cm$^2$; and a resistivity of original fiber is in a range of $10^0$–$10^5$ Ωcm.

FIG. 3(*a*) and FIG. 3(*b*) show cross sectional views of a press-contacting release mechanism 9C (separating section) of the opposing electrode 9B in the discharging device before secondary transfer 9. FIG. 3(*a*) shows a cross sectional view of the discharging device before secondary transfer 9 in a main scanning direction, while FIG. 3(*a*) shows a cross sectional view of the same in a sub-scanning direction. As shown in FIG. 3(*a*) and FIG. 3(*b*), the discharging device before secondary transfer 9 is so constituted that the opposing electrode 9B face-contacts the intermediate transfer member 7.

The press-contacting release mechanism 9C of the discharging device before secondary transfer 9 is constituted by a movable supporting member 95 for supporting the conductive brush 94, a plurality of guide members 96 for movably guiding the movable supporting member 95, a base plate 97 for holding the plurality of guide members 96, a spring 98 for pressing the conductive brush 94 onto the intermediate transfer member 7 by urging the movable supporting member 95.

The movable supporting member 95 is coupled to a solenoid SD. Supplying electric current to the solenoid SD, the conductive blush 94 supported by the movable supporting member 95 press-contacts the intermediate transfer member 7. Accordingly, when the power source of the image forming apparatus A is turned OFF, the conductive brush 94 comes apart from the intermediate transfer member 7 and enters in a releasing state.

Figure 4:
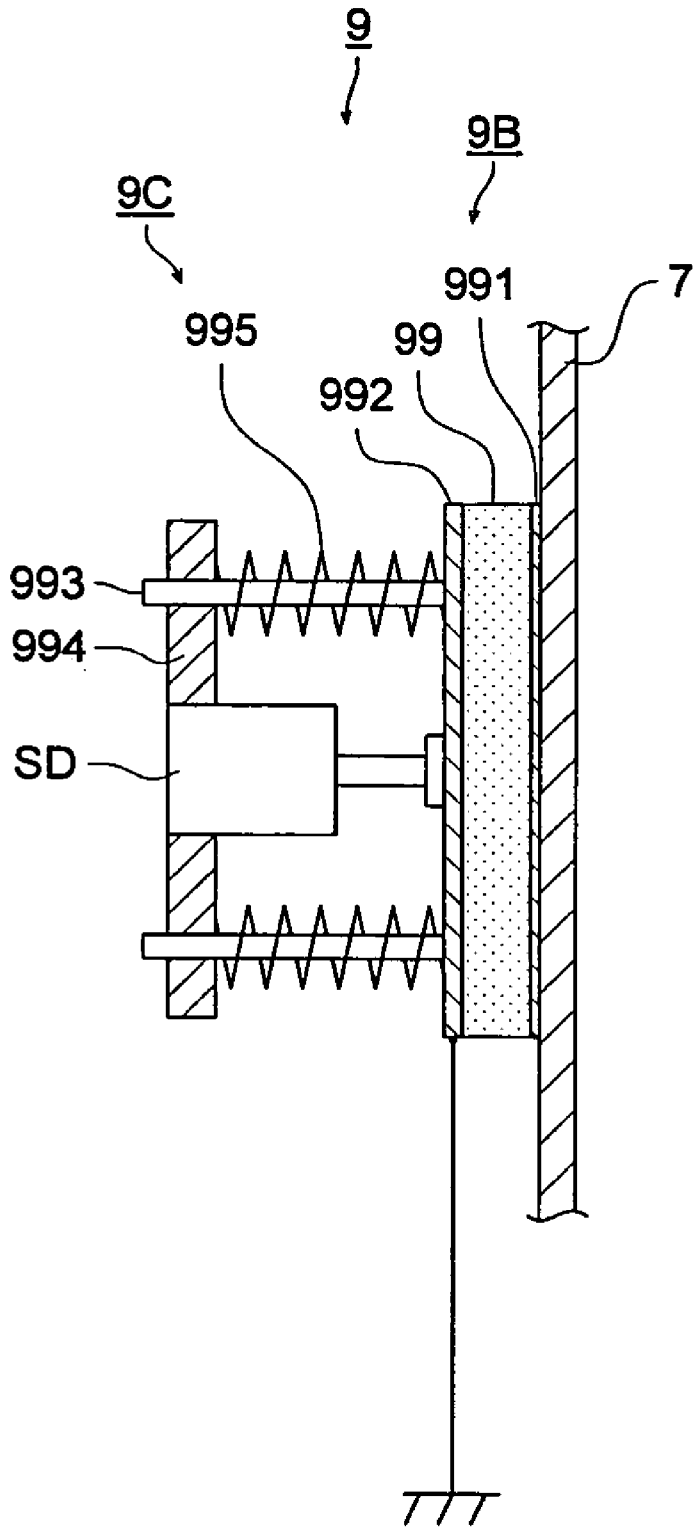
FIG. 4 shows a cross sectional view of another embodiment of an opposing electrode.

FIG. 4 shows a cross sectional view of another embodiment of the opposing electrode 9B.

It is also applicable that the opposing electrode 9B of the discharging device before secondary transfer 9 is a conductive foam member coupled to the ground.

The opposing electrode 9B is constituted by integrally press-holding a conductive foam member 99, a conductive member 991, having a wear resisting property and press-contacting the inner surface of the intermediate transfer member 7, and a movable supporting member 992 for supporting the conductive foam member 99 as a layer structure.

The conductive foam member 99 is made by mixing a conductive carbon black with a foamed material, such as sponge, etc. To mix the conductive carbon black, a method for impregnating a liquid dispersing the conductive carbon black with a high polymer material, a method for adding the conductive carbon black to a resin material and kneading the mixture in the formulation step, etc. can be cited as a manufacturing method of the conductive foam member 99. The foam material mixed with the conductive carbon black allows the electric current to flow into the high polymer material.

Instead of the method employing the carbon black, a method for urging an ionization due to non-localization of electric charge by doping an iodine or a pentafleuoroarsenic into a chemical compound in which a backbone chain is structured by conjugated double bonds, for instance, such as a polyacetylene, a polyphenylacetylene, a poly-p-phenylene, a high polymer metalphthaloeyanine, etc., is also applicable.

A wear resistant material, for instance, such as a conductive stainless steel plate, a cupper alloy metal, a zinc alloy metal, a tin alloy metal, etc., can be employed as the conductive member 991.

The structure of the press-contacting release mechanism 9C of the opposing electrode 9B is substantially the same as that of the press-contacting release mechanism 9C of the conductive brush 94. And the mechanism is constituted by the movable supporting member 992 for supporting a conductive foam member 99, a plurality of guide members 993 for guiding the movable supporting member 992 in a movable state, a base plate 994 placed at the main frame side for holding the guide members 993, springs 995 for urging the movable supporting member 992 so as to press the conductive foam member 99 onto the intermediate transfer member 7, and etc.

The movable supporting member 992 is coupled to a solenoid SD. Supplying electric current to the solenoid SD, the conductive foam member 99 supported by the movable supporting member 992 press-contacts the intermediate transfer member 7. Accordingly, when the power source of the image forming apparatus A is turned OFF, the conductive foam member 99 comes apart from the intermediate transfer member 7 and enters in a releasing state.

Figure 5:
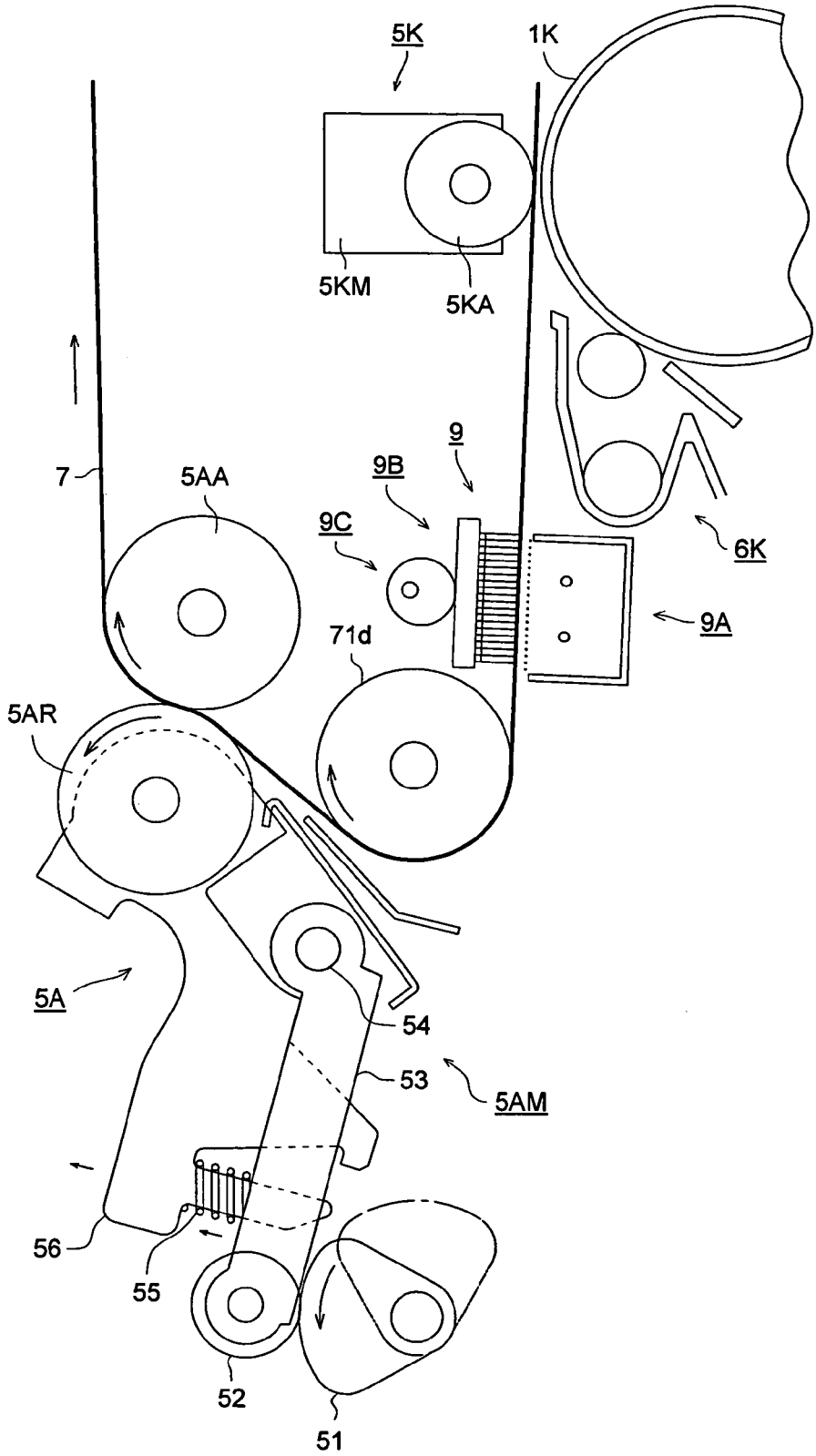
FIG. 5 shows a cross sectional view of a configuration of a primary transferring device, a discharging device before secondary transfer, a secondary transferring device and a intermediate transfer member.

FIG. 5 shows a cross sectional view of the configuration of the primary transferring device 5K, the discharging device before secondary transfer 9, the secondary transferring device 5A and the intermediate transfer member 7.

A primary transferring roller 5KA of the primary transferring device 5K is movable between the primary transfer operating position and a separate position being apart from the intermediate transfer member 7 by means of the first separating mechanism 5KM.

The opposing electrode 9B of the discharging device before secondary transfer 9 is movable between the discharge operating position before secondary transfer and a separate position being apart from the intermediate transfer member 7 by means of the press-contacting release mechanism 9C serving as the second separating mechanism.

A secondary transferring roller 5KR of the secondary transferring device 5A is movable between the secondary transfer operating position and a separating position being apart from the intermediate transfer member 7 by means of a third separating mechanism 5AM.

A cum 51 of the third separating mechanism 5AM is supported by the supporting member of the apparatus main frame and rotated in a direction indicated by the arrow shown in FIG. 5 by a motor (not shown in the drawings). A roller 52 movably supported at another end portion of a lever 53 is moved by the cum 51 while following the outer contour of the cum 51. The lever 53 supporting the roller 52 swings around a rotating axis 54, which is movably supported by the supporting member of the apparatus main frame, in a direction indicated by the arrow shown in FIG. 5. The swinging action of the lever 53 pushes an end portion of a secondary transfer roller supporting member 56 through a spring 55 so that the secondary transfer roller supporting member 56 also swings around the rotating axis 54. The swinging action of the secondary transfer roller supporting member 56 makes the secondary transferring roller 5AR, which is movably supported at the upper portion of the secondary transfer roller supporting member 56, press-contact the intermediate transfer member 7, so as to push the secondary transferring backup roller 5AA with a pressure while putting the intermediate transfer member 7 between them.

Figure 6:
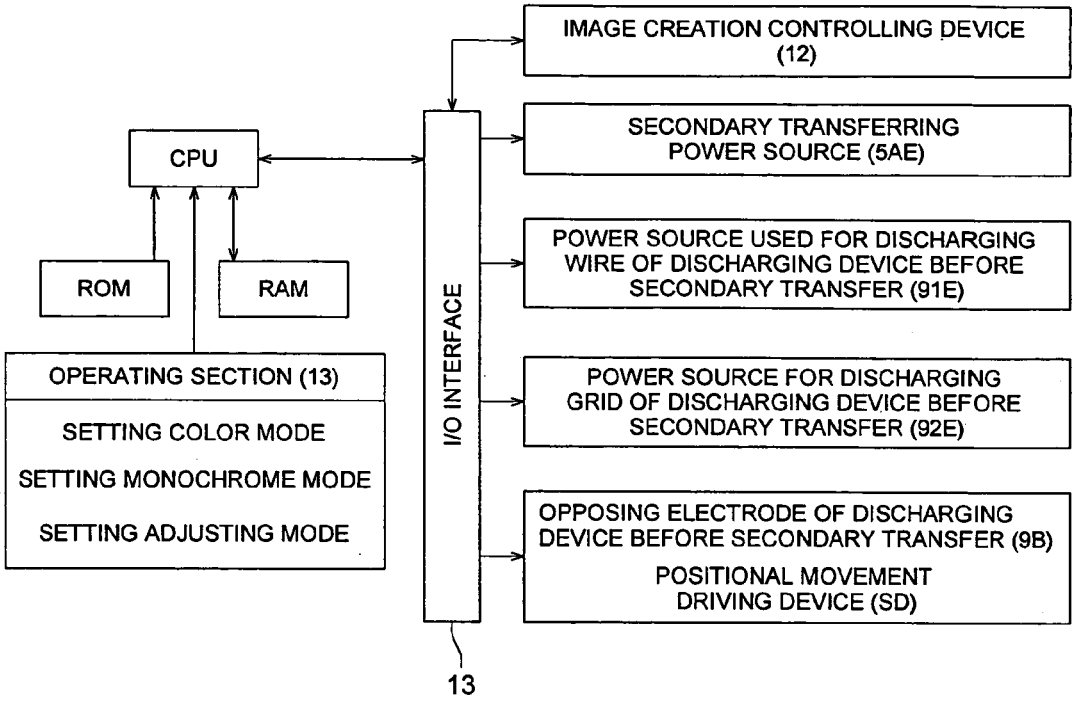
FIG. 6 shows a block diagram indicating the operations for controlling a discharging device before secondary transfer.

FIG. 6 shows a block diagram indicating the operations for controlling the discharging device before secondary transfer 9.

An image creation controlling section 12 of the image forming apparatus A is coupled to the secondary transferring power source 5AE, the power source 91E used for the discharging wire before secondary transfer (the electric discharge electrode), the power source 92E used for the grid of the discharging device before secondary transfer 9 and the second separating mechanism (solenoid SD, etc.) for moving the position of the opposing electrode 9B of the discharging device before secondary transfer 9, through an interface 13 to which a computer having a ROM and a RAM is also coupled.

The first separating mechanisms make the primary transferring rollers 5YA, 5MA, 5CA, 5KA, for pushing the intermediate transfer member 7 against the photoreceptor drums 1Y, 1M, 1C, 1K in the press-contacting state, movable between the transfer operating positions and separate positions being apart from the intermediate transfer member 7, respectively. The second separating mechanism makes the opposing electrode 9B of the discharging device before secondary transfer 9, movable between the transfer operating position (an operating position) and a separate position being apart from the intermediate transfer member 7.

Further, the operator selects any one of a color mode, a monochrome mode and an adjusting mode to be set through the operating section 11. According to the selected mode, the CPU controls the secondary transferring power source 5AE, the power source 91E used for the discharging wire before secondary transfer (the electric discharge electrode), the power source 92E used for the grid of the discharging device before secondary transfer 9, a positional movement driving mechanism for moving the opposing electrode 9B of the discharging device before secondary transfer 9, etc.

In the image forming apparatus A, it is possible to select either the monochrome mode for forming only the toner image of color K (Black) or the color mode for forming the color toner image by overlapping a plurality of unicolor toner images. When forming the toner image of color K (Black) in the monochrome mode, the press-contacting release mechanism 9C makes the opposing electrode 9B move to the separating position, in conjunction with the action of making the intermediate transfer member 7 come apart from the photoreceptor drums 1Y, 1M, 1C, 1K.

In the adjusting mode in which the toner image formed on the intermediate transfer member 7 is not transferred onto the transfer material P by the secondary transferring device 5A, the opposing electrode 9B of the discharging device before secondary transfer 9 is made to move to the separating position, in conjunction with the press-contact releasing action performed by the third separating mechanism 5AM.

Further, in a state that the image is not formed, the opposing electrode 9B is positioned at a standby position being apart from the intermediate transfer member 7 by the second separating mechanism.

When the adjusting mode is selected, the image forming apparatus A releases the secondary transferring device 5A from the press-contacting action to the intermediate transfer member 7 by means of the third separating mechanism 5AM. In conjunction with this releasing operation, the opposing electrode 9B is made to move to the separating position.

Incidentally, in the adjusting mode, an adjustment of the image density, such as a maximum density Dmax, a gradation characteristic $\gamma$, etc., is performed. In the adjusting mode, instead of the normal image forming operations, for instance, toner patches (having a various densities) are formed on the transferring belt at the time when the main power switch is turned ON or every time when a predetermined number of image forming operations are completed. And then, the densities of the toner patches are detected by the Image Density Sensor, so that the CPU can change the developing condition or the charging condition on the basis of the information acquired by the Image Density Sensor. By this operation, it becomes possible to continuously obtain stable images. Since the normal image forming operations are not performed in the adjusting mode, the opposing electrode 9B is not necessary in this mode. Accordingly, by making the opposing electrode 9B move to the separating position at the time of the adjusting mode, it becomes possible to extend the lifetime of the opposing electrode 9B.

Incidentally, although an example in which an intermediate transfer belt is employed as the intermediate transfer member 7 has been described as an embodiment of the present invention in the forgoing, the scope of the present invention is not limited to the above. It is also applicable that an intermediate transfer body formed in another shape, for instance, an intermediate transfer drum is employed instead of the intermediate transfer member 7. Further, the property of the intermediate transfer member 7, such as electric characteristics, a thickness, a material, etc., can be employed by selecting them on the basis of the image creating conditions, etc.

The conductive brush 94 and the conductive foam member 99 made by the abovementioned process are also applicable to the charging member, discharging member, etc. to be used for a copier, printer, etc., which employs an electrostatic photographic method.

According to the embodiments, the following effects can be attained.

(1) Since the discharging device before secondary transfer, which is disposed at a position between the primary transferring device and the secondary transferring device, and which includes the electric discharge electrode disposed at a position opposing to the toner image bearing surface of the intermediate transfer member, and the opposing electrode made of a conductive material and disposed at a position opposing to the electric discharge electrode while putting the intermediate transfer member between them in such a manner that the opposing electrode face-contacts the intermediate transfer member, is equipped, it becomes possible to improve the discharging efficiency due to an increase of the contact area for the intermediate transfer member, and to obtain a high quality image even if the line velocity of the intermediate transfer member is increased according to the high speed trend of the image forming operation, compared to the conventional driven-roller-type opposing electrode. Further, since the opposing electrode is movable between the operating position at which the opposing electrode contacts the intermediate transfer member and the separating position at which the opposing electrode is apart from the intermediate transfer member by means of the separating mechanism, the opposing electrode conducts the discharging operation before secondary transfer at the operating position only when forming the toner image and moves to the separating position when not forming the toner image, resulting in an improvement of the durability of the opposing electrode.

(2) Since the opposing electrode is either a conductive brush or a conductive foam material, coupled to the ground, it becomes possible to improve the discharging efficiency due to an increase of the contact area for the intermediate transfer member, and to obtain a high quality image even if the line velocity of the intermediate transfer member is increased according to the high speed trend of the image forming operation, compared to the conventional driven-roller-type opposing electrode.

(3) Since the opposing electrode is disposed at the operating position in such a manner that the opposing electrode press-contacts the intermediate transfer member with a contact area, it becomes possible to improve the discharging efficiency due to an increase of the contact area for the intermediate transfer member, and to obtain a high quality image even if the line velocity of the intermediate transfer member is increased according to the high speed trend of the image forming operation.

(4) Since the separating mechanism moves the opposing electrode from the separating position to the operating position synchronizing with the operation for applying a voltage to the electric discharge electrode, it becomes possible to improve the durability of the opposing electrode, by press-contacting the opposing electrode with the intermediate transfer member only when performing the discharging operation before secondary transfer.

(5) Since the image forming apparatus is provided with the monochrome mode for forming only the toner image of color K (Black) or the color mode for forming the color toner image by overlapping a plurality of unicolor toner images, and when forming the toner image of color K (Black) in the monochrome mode, the second separating mechanism moves the opposing electrode to the separating position, in conjunction with the action of making the intermediate transfer member come apart from a plurality of the photoreceptor drums, for forming the color toner image by overlapping a plurality of unicolor toner images, performed by the first separating mechanism, it becomes possible to reduce wears of the intermediate transfer member and the opposing electrode, which are press-contacted with each other when forming an image in the monochrome mode.

(6) In the adjusting mode in which the secondary transferring device does not transfer the toner image, formed on the intermediate transfer member, onto the transfer material, the press-contacting release mechanism, for releasing the press-contacting state of the secondary transferring device and the intermediate transfer member, moves the opposing electrode to the separating position in conjunction with the press-contact releasing operation conducted by the releasing device. Accordingly, it becomes possible to reduce wears of the intermediate transfer member and the opposing electrode, which are press-contacted with each other when forming an image in the adjusting mode.

(7) Since the opposing electrode is placed at a standby position being apart from the intermediate transfer member by means of the first separating mechanism in a state that no image is formed, it becomes possible to reduce wears of the intermediate transfer member and the opposing electrode, which are press-contacted with each other when forming an image.

While the preferred embodiments of the present invention have been described using specific term, such description is for illustrative purpose only, and it is to be understood that changes and variations may be made without departing from the spirit and scope of the appended claims.

What is claimed is:

1. A color image forming apparatus, comprising:

a plurality of primary transferring devices to transfer a plurality of color toner images respectively formed on a plurality of image bearing members onto an intermediate transfer member;

a secondary transferring device to transfer said color toner image formed on said intermediate transfer member, onto a transfer material;

a discharging device before secondary transfer, disposed at a position between a primary transferring device and said secondary transferring device, wherein said primary transferring device is one of said plurality of primary transferring devices located at a position nearest to said secondary transferring device, and wherein said discharging device before secondary transfer includes:

an electric discharge electrode disposed at a position opposing to a toner image bearing surface of said intermediate transfer member; and an opposing electrode made of a conductive material and disposed at a position opposing to said electric discharge electrode while putting said intermediate transfer member between them in such a manner that said opposing electrode face-contacts said intermediate transfer member; and a separating device to make said opposing electrode movable between an operating position at which said opposing electrode contacts said intermediate transfer member and a separating position being apart from said intermediate transfer member.

2. The color image forming apparatus of claim 1, wherein said opposing electrode is coupled to the ground.

3. The color image forming apparatus of claim 2, wherein said opposing electrode is made of a conductive brush.

4. The color image forming apparatus of claim 2, wherein said opposing electrode is made of a conductive foam material.

5. The color image forming apparatus of claim 1, wherein said opposing electrode is disposed in such a manner that said opposing electrode face-contacts and rubs the intermediate transfer member with a contacting area at said operating position.

6. The color image forming apparatus of claim 2, wherein said opposing electrode is disposed in such a manner that said opposing electrode face-contacts and rubs the intermediate transfer member with a contacting area at said operating position.

7. The color image forming apparatus of claim 1, wherein said separating device moves said opposing electrode from said separating position to said operating position synchronizing with an operation for applying a voltage to said electric discharge electrode.

8. The color image forming apparatus of claim 1, wherein said separating device makes said opposing electrode face-contact and rub the intermediate transfer member only when activating a discharging operation before secondary transfer.

9. The color image forming apparatus of claim 1, wherein said separating device makes said opposing electrode come apart from the intermediate transfer member when image-forming operations are not conducted.

10. A color image forming apparatus, comprising:

a plurality of primary transferring devices to transfer a plurality of unicolor toner images respectively formed on a plurality of image bearing members onto an intermediate transfer member in such a manner that said plurality of unicolor toner images overlap with each other to form a multi-color toner image;

a secondary transferring device to transfer said multi-color toner image formed on said intermediate transfer member onto a transfer material;

a discharging device before secondary transfer, disposed at a position between a primary transferring device and said secondary transferring device, wherein said primary transferring device is one of said plurality of primary transferring devices located at a position nearest to said secondary transferring device, and wherein said discharging device before secondary transfer includes:

an electric discharge electrode disposed at a position opposing to a toner image bearing surface of said intermediate transfer member; and an opposing electrode made of a conductive material and disposed at a position opposing to said electric discharge electrode while puffing said intermediate transfer member between them in such a manner that said opposing electrode face-contacts said intermediate transfer member;

a first separating device to make said plurality of image bearing members and said intermediate transfer member come apart from each other; and a second separating device to make said opposing electrode movable between an operating position at which said opposing electrode contacts said intermediate transfer member and a separating position being apart from said intermediate transfer member;

wherein a monochrome mode for forming a black toner image and a color mode for forming a color toner image by overlapping said plurality of unicolor toner images with each other are selectively provided in said image forming apparatus; and wherein, when forming said black toner image in said monochrome mode, the second separating device moves said opposing electrode to said separating position, in conjunction with an action of making said intermediate transfer member come apart from said plurality of image bearing members by said first separating device.

11. The color image forming apparatus of claim 10, wherein, when no image forming operation is performed, said second separating device makes said opposing electrode come apart from said intermediate transfer member.

12. The color image forming apparatus of claim 10, wherein said opposing electrode is coupled to the ground.

13. The color image forming apparatus of claim 10, wherein said opposing electrode is made of a conductive brush.

14. The color image forming apparatus of claim 10, wherein said opposing electrode is disposed in such a manner that said opposing electrode face-contacts and rubs the intermediate transfer member with a contacting area at said operating position.

15. A color image forming apparatus, comprising:

a plurality of primary transferring devices to transfer a plurality of color toner images respectively formed on a plurality of image bearing members onto an intermediate transfer member;

a secondary transferring device to transfer said color toner image, formed on said intermediate transfer member, onto a transfer material;

a discharging device before secondary transfer, disposed at a position between a primary transferring device and said secondary transferring device, wherein said primary transferring device is one of said plurality of primary transferring devices located at a position nearest to said secondary transferring device, and wherein said discharging device before secondary transfer includes:

an electric discharge electrode disposed at a position opposing to a toner image bearing surface of said intermediate transfer member; and an opposing electrode made of a conductive material and disposed at a position opposing to said electric discharge electrode while puffing said intermediate transfer member between them in such a manner that said opposing electrode face-contacts said intermediate transfer member;

a separating device to make said opposing electrode movable between an operating position at which said opposing electrode contacts said intermediate transfer member and a separating position being apart from said intermediate transfer member; and a press-contact releasing device to release a press-contacting state of said secondary transferring device and said intermediate transfer member;

wherein, in an adjusting mode in which said secondary transferring device does not transfer said color toner image formed on said intermediate transfer member onto said transfer material, said separating device moves said opposing electrode to said separating position in conjunction with a press-contact releasing operation conducted by said press-contact releasing device.

16. The color image forming apparatus of claim 15, wherein, when no image forming operation is performed, said separating device makes said opposing electrode come apart from said intermediate transfer member.

17. The color image forming apparatus of claim 15, wherein said opposing electrode is coupled to the ground.

18. The color image forming apparatus of claim 17, wherein said opposing electrode is made of a conductive brush.

19. The color image forming apparatus of claim 16, wherein said opposing electrode is disposed in such a manner that said opposing electrode face-contacts and rubs the intermediate transfer member with a contacting area at said operating position.

* * * * *